US005366567A

United States Patent [19]

Ogino et al.

[11] Patent Number: 5,366,567

[45] Date of Patent: Nov. 22, 1994

[54] METHOD FOR CHROMATING TREATMENT OF ZINC COATED STEEL

[75] Inventors: Takao Ogino; Arata Suda, both of Hiratsuka; Takayuki Aoki, Yokohama; Mitsuyuki Koga, Sakura, all of Japan

[73] Assignee: Henkel Corporation, Plymouth Meeting, Pa.

[21] Appl. No.: 39,155

[22] PCT Filed: Oct. 7, 1991

[86] PCT No.: PCT/US91/07305

§ 371 Date: Apr. 7, 1993

§ 102(e) Date: Apr. 7, 1993

[30] Foreign Application Priority Data

Oct. 8, 1990 [JP] Japan ..... 2-270131

[51] Int. Cl.[5] ..... C23C 22/37

[52] U.S. Cl. ..... 148/258; 148/267

[58] Field of Search ..... 148/258, 267

[56] References Cited

U.S. PATENT DOCUMENTS

| | | | |
|---|---|---|---|
| 4,671,825 | 6/1987 | Ishii et al. | 148/6.15 |
| 5,091,023 | 2/1992 | Saeki | 148/258 |
| 5,141,575 | 8/1992 | Yoshitake | 148/258 |
| 5,230,750 | 7/1993 | Shindou | 148/258 |

FOREIGN PATENT DOCUMENTS

| | | |
|---|---|---|
| 0214571 | 3/1987 | European Pat. Off. . |
| 50-158535 | 12/1975 | Japan . |
| 58-22383 | 2/1983 | Japan . |
| 61-000584 | 6/1986 | Japan . |
| 62-83478 | 4/1987 | Japan . |
| 63-103082 | 5/1988 | Japan . |
| 63-262477 | 10/1988 | Japan . |

OTHER PUBLICATIONS

*Chromate Treatment of Metal-Coated Steel sheets;* Chemical Abstracts, vol. 99, No. 6, p. 214.

*Chromating Bath for Galvanized Steel Sheets;* Chemical Abstracts, vol. 109, No. 12, p. 235.

*Primary Examiner*—Sam Silverberg

*Attorney, Agent, or Firm*—Ernest G. Szoke; Wayne C. Jaeschke; Norvell E. Wisdom, Jr.

[57] ABSTRACT

A chromating composition including hexavalent and trivalent chromium, phosphate ions, silica, and a silane coupling agent and with ratios among its components within certain specified ranges produces a protective layer on the surface of zinc coated steel treated with the composition that has an excellent alkali resistance, corrosion resistance, coatability, and welding tolerance.

20 Claims, No Drawings

METHOD FOR CHROMATING TREATMENT OF ZINC COATED STEEL

TECHNICAL FIELD

The present invention relates to a chromate treatment method which can produce a strongly corrosion-resistant, alkali resistant, and weld-tolerant chromate film, with excellent paint film adherence and corrosion resistance after painting, on the surface of electrogalvanized steel, zinc alloy electroplated steel, galvannealed hot dip galvanized steel, or any other type of iron or steel with a surface coating that is predominantly zinc, all of these various types of coated steel being encompassed within the term "zinc coated steel" as used herein. The method according to the invention is particularly adapted to coating sheet stock.

BACKGROUND ART

While older chromate treatment baths consisted simply of aqueous solutions of chromic acid or dichromic acid, in recent years various improved methods have been proposed in which the chromate treatment bath lays down a film which is only slightly soluble in acid or alkaline treatment liquid compositions which may follow chromate film formation. Examples of this relatively recent art will be considered below.

The teaching of Japanese Patent Application Laid Open [Kokai or Unexamined] Number 50-158,535 [158,535/75] concerns a method for the formation of a slightly soluble chromate film on the surface of zinc coated steel sheet. A chromate bath is disclosed which is based on chromic anhydride ($CrO_3$)+phosphoric acid ($H_3PO_4$)+water soluble or water dispersible polymeric compound. At least 70% of the hexavalent chromium ion in this treatment bath is reduced by a reductant such as ethylene glycol or the like. However, since the chromate films formed according to the examples of this invention contain polymer, they suffer from a poor weldability although they are excellent with regard to lack of solubility, corrosion resistance, and adhesion to paint and corrosion resistance after painting (the last two characteristics being sometimes briefly denoted hereinafter as "coatability").

The chromate bath disclosed in Japanese Patent Publication Number 61-58522 [58,522/86] is a chromic acid ($CrO_3$) +chromic acid reduction product+silica sol system. The major disadvantage with the method according to this invention is the tendency for the chromium, chiefly the hexavalent chromium, in the chromate film to elute during the alkaline rinse which is carried out after chromating but before the treated steel sheet carrying the chromate film is painted. This results in a decline in the film's corrosion resistance.

Japanese Patent Application Laid Open Numbers 58-22383 [22,383/83] and 62-83478 [83,478/87] disclose the use silane coupling agent in order to reduce the hexavalent chromium ion in the chromate treatment bath. Each of the films formed by the methods according to these inventions provides an excellent paint-film adherence. However, the chromate film produced by the method of the first invention has a poor alkali resistance. The alkali resistance is similarly unsatisfactory in the case of the method according to the second invention.

DESCRIPTION OF THE INVENTION

Problem to Be Solved by the Invention

The present invention seeks to solve the various problems associated with the prior art by introducing a method for the chromate treatment of zinc coated steel sheet which produces a strongly corrosion resistant, alkali resistant, and weld tolerant chromate film which also has good coatability.

SUMMARY OF THE INVENTION

The present invention comprises a method for the chromate treatment of zinc coated steel that comprises and is characterized by steps of:

(1) providing an aqueous liquid chromate containing composition made by substeps (1.1)–(1.2) or by substeps (1.1')–(1.3'), where substeps (1.1)–(1.2) are:

(1.1) preparing a preliminary aqueous liquid composition which comprises, or more preferably consists essentially of, or still more preferably consists of, water and:

(1.1.a) a source of ions containing hexavalent chromium to provide from 3.5 to 50.0 grams per liter (hereinafter "g/L") of dissolved hexavalent chromium;

(1.1.b) a source of trivalent chromium ions to provide from 2.0 to 40.0 g/L of trivalent chromium: and (1.1.c) a source of phosphate ions to provide from 1.0 to 100 g/L of phosphate ions; and, optionally, (1.1.d) the residue from a reducing agent added to reduce some of the hexavalent chromium originally present to trivalent chromium, said preliminary aqueous liquid composition having a weight ratio of trivalent chromium to hexavalent chromium in the range from 0.25 to 1.5 and a weight ratio of phosphate ions to total chromium ion in the range from 0.1 to 1.2; and (1.2) adding to the preliminary aqueous liquid composition prepared in step (1.1):

(1.2.a) an amount of colloidally dispersed silica that provides a ratio of from 0.1 to 1.2 for the weight of dispersed silica to total weight of chromium ions in the resulting composition; and (1.2.b) an amount of silane coupling agent that provides a ratio of the moles of silane coupling agent in the resulting composition to the moles of hexavalent chromium in the resulting composition in the range from 0.05 to 0.3;

and substeps (1.1')–(1.3') are:

(1.1') preparing a first aqueous partial composition comprising a source of hexavalent chromium and a source of trivalent chromium and, optionally, also comprising the residue from a reducing agent added to reduce some of the hexavalent chromium originally present to trivalent chromium;

(1.2') preparing a second aqueous partial composition comprising phosphate ions, dispersed colloidal silica, and a silane coupling agent; and (1.3') mixing said first and second aqueous partial compositions to produce an aqueous liquid chromate containing composition that could have been prepared by steps (1.1)–(1.2);

(2) covering the surface of the zinc coated steel with a layer of the aqueous liquid chromate containing composition provided in step (1), said layer containing from 10 to 150 milligrams of total chromium per square meter of zinc coated steel surface covered; and (3) drying into place on the coated steel surface the covering liquid put in place in step (2).

In this description, the term "phosphate ions" is to be understood to include the stoichiometric equivalent as phosphate ions of phosphoric acid ($H_3PO_4$) and all anions formed by partial ionization of phosphoric acid that are present in the composition. Also, in the description below, the term denoted above as "ions containing hexavalent chromium" is often denoted alternatively as "hexavalent chromium ions" although it is known that such ions in aqueous solution are normally anions containing both chromium and oxygen. The stoichiometric equivalent as chromium atoms of the hexavalent chromium present is to be understood as the quantity described for hexavalent chromium ions when specified by numerical amounts or concentrations.

ADDITIONAL DESCRIPTION OF THE INVENTION

The preferred source of hexavalent chromium ions for the composition used in this invention is the chemical sometimes known as chromic anhydride and sometimes known as chromic acid, in either case with the chemical formula $CrO_3$. The preferred source of trivalent chromium is that produced by reducing some of the original hexavalent chromium content of the solution with an organic material, such as methanol, that produces carbon dioxide as the primary oxidation product.

When the hexavalent chromium ion concentration falls below 3.0 g/L, or when the trivalent chromium ion concentration falls below 2.0 g/L, the formation of a satisfactorily corrosion resistant chromate film becomes problematic. On the other hand, when the hexavalent chromium ion concentration exceeds 50.0 g/L, or when the trivalent chromium ion concentration exceeds 40.0 g/L, the chromate bath undergoes an increase in viscosity and its stability is also degraded; this impairs the ability to control the chromium add-on weight satisfactorily.

Furthermore, the trivalent/hexavalent chromium ion ratio is also a crucial aspect of the invention. When this chromium ion weight ratio falls below 0.25, the hexavalent chromium ion concentration in the chromate bath is relatively increased to such a degree that the hexavalent chromium ion in the chromate bath is then too readily reduced by the silane coupling agent admixed into said bath. This results in a diminution in the quality of the chromate bath. Chromium ion weight ratios in excess of 1.5 are strongly associated with gelation of the chromate bath and also with a deterioration in the corrosion resistance of the chromate film which is formed.

The chromium ion weight ratio can, as already noted above, be adjusted by the addition as necessary of a known reductant such as ethanol, methanol, oxalic acid, starch, sucrose, or the like.

Another component in the chromate bath according to the present invention is phosphate ion at 1.0 to 100 g/L. The phosphate ion is preferably added as orthophosphoric acid ($H_3PO_4$). The corrosion resistance and alkali resistance of the chromate film deteriorate when the quantity of phosphate ion falls below 1.0 g/L. Values in excess of 100 g/L cause a rapid development in the chromate bath of reduction of the hexavalent chromium ion by the silane coupling agent, and this causes a decline in the quality of the chromate bath.

The phosphate ion/total chromium ion (trivalent+hexavalent chromium ion) ratio for the chromate bath is a critical factor for the phosphate ion quantity, and the phosphate ion/total chromium ion weight ratio must fall within the range of 0.1 to 1.2. The corrosion resistance and alkali resistance of the chromate film tend to deteriorate when this ratio has a value less than 0.1. A strong development of the reduction reaction of the hexavalent chromium ion by the silane coupling agent will tend to occur in the chromate bath at values of the ratio in excess of 1.2. As a consequence, most or almost all of the hexavalent chromium ion in the chromate bath will be reduced to trivalent chromium ion prior to application of the chromate bath, and the quality of the chromate coating formed will be degraded.

The corrosion resistance will be unsatisfactory when the silica sol concentration falls below 10% (referred to the total chromium ion concentration). The weldability is reduced above 120%. Either case precludes the formation of a film in conformity with the object of the present invention.

Examples of commercially available silica sols which are suitable for the present invention are Aerosil TM #200, Aerosil TM 190 300, and Aerosil TM #380 (from Nippon Aerosil) and Snotex-O TM and Snotex-OUP TM (from Nissan Chemical).

After addition of the silane coupling agent to the water based chromate bath as described hereinbefore, the chromate bath should be maintained at ±35° C. and preferably at a temperature of about 25° C. and should preferably be used as soon as possible after its preparation. Bath stability will be satisfactory for approximately one month at low chromium concentrations, but high chromium concentrations require application of the bath within a week of the addition of the silane coupling agent.

The silane coupling agent itself is to be admixed so as to obtain values within the range of 0.05 to 0.3 (at the time of coating) for the molar ratio between silane coupling agent and the molar concentration of hexavalent chromium remaining after the partial reduction of the hexavalent chromium in the chromate bath by the added silane coupling agent.

The preferred method for the preparation of the chromate bath comprises addition of the silica sol and silane coupling agent to a water-based chromate bath as described hereinbefore {steps (1.1)–(1.2) as set forth above}. However, as also noted above, another permissible method comprises the addition of silica sol and silane coupling agent to a phosphoric acid solution in order to prepare a starting bath, to which aqueous chromium containing solution is then added. Any other method that produces a composition with the same chemical characteristics is also within the scope of the present invention.

No necessary restriction is placed on the silane coupling agent, but preferred silane coupling agents conform to one of the general formulas $(YR)_mSiX_n$ and $Y_nSiX_n$, wherein each of m and n, which may be the same or different, is a positive integer and:

$m+n=4$;

$n=1$, 2, or 3;

R = a moiety derived from an alkyl group by removing one hydrogen atom therefrom;

X = methoxy or ethoxy; and

Y = vinyl, mercapto, glycidoxy, or methacryloxy.

Concrete examples of the preferred type of silane coupling agent are vinyltrimethoxysilane, gamma-mercaptopropyltrimethoxysilane, gamma-glycidoxypropyltrimethoxysilane, gamma-glycidoxypropylmethyldimethoxysilane, gamma-methacryloxypropyltrimethoxysilane, and gamma-methacryloxypropylmethyldimethoxysilane.

When the molar ratio for silane coupling agent addition relative to hexavalent chromium ion falls below 0.05, the chromate film's alkali resistance will usually be unsatisfactory. At values in excess of 0.3, the stability of the chromate bath will undergo a gradual decline, i.e., the trivalent chromium ion in the chromate bath increases, and the chromate bath will then evidence a strong tendency to gel during the interval from its preparation to its application and drying. It is even more preferred that the silane coupling agent be added to give molar ratios within the range of 0.1 to 0.2.

The chromate bath, after admixture of the silane coupling agent as described above, may be applied to the surface of zinc coated steel sheet using, for example, a roll coater, and this is followed by drying. No necessary restrictions are placed on the drying conditions within the context of the present invention, but the protective film is preferably formed by drying at a metal temperature of 60° to 150° C. for 5 to 10 seconds.

Values for the chromium add-on to the zinc coated steel below 10 mg/m$^2$ are associated with an unsatisfactory corrosion resistance of the chromate film and with an unsatisfactory post-painting corrosion resistance. At add-on values in excess of 150 mg/m$^2$ not only does it become difficult to control the chromium add-on, but the improvement in corrosion resistance also becomes saturated, so that no increased benefit to offset the greater cost can be expected. Also, too thick a chromate film is very vulnerable to removal by external force, which leads to a deterioration in the weldability and also causes a decline in paint film adherence.

The pH of the water-based chromate composition specified for use in the present invention is not particularly restricted, but values of 1.0 to 3.0 are preferred.

The practice of this invention can be further appreciated from the following, non-limiting, examples and comparison examples.

EXAMPLES

(1) Preparation of the chromate coating baths

Chromate coating bath No. A as reported in Table 1 was prepared as follows. First, 200 grams (hereinafter "g") of chromic anhydride ($CrO_3$) was dissolved in 500 g water; 86 g phosphoric acid (75% aqueous solution) and 18 g methanol were added to the aqueous solution thus obtained; and this was heated at 80° to 90° for 1 hour in order to effect partial reduction of the hexavalent chromium content to produce a {trivalent chromium ion}/{hexavalent chromium ion} weight ratio of 1.0. After cooling, water was added to afford a total of 1 kilogram of water based chromate starting bath.

This water-based chromate starting bath was diluted with water to afford a total chromium ion titer of 40 g/L. 20 g/L of silica sol (Aerosil TM #200 from Nippon Aerosil) and 9 g/L of silane coupling agent (gamma-glycidoxypropyltrimethoxysilane from Toshiba Silicone) were added to afford chromate coating bath A.

Chromate coating baths B through K were prepared by the same procedure as for chromate coating bath A, using the corresponding amounts of ingredients reported in Table 1.

(2) Chromate treatment method

Chromate coating composition prepared as above was applied by the process steps laid out in the "Process Step Schematic Chart" below to the surfaces of electrogalvanized steel sheets and to the surfaces of zinc/nickel alloy electroplated steel sheet. Drying afforded the results reported in Table 2.

(3) Preparation of painted sheet

The chromate-treated steel sheet, either directly or after an alkali rinse as in (4)(a), was coated with a baking melamine alkyd paint (Delicon TM 700 White from Dainippon Toryo) followed by baking/drying at 140° C. for 20 minutes to afford the painted sheet (paint film thickness =25 micrometers).

TABLE 1

| chromate coating bath | $Cr^{6+}$ g/L | $Cr^{3+}$ g/L | $PO_4^{3-}$ g/L | $Cr^{3+}/Cr^{6+}$ | $PO_4^{3-}$/total Cr | $SiO_2$ g/L | $SiO_2$/total Cr | silane coupling agent g/L | silane coupling agent/$Cr^{6+}$ molar ratio |
|---|---|---|---|---|---|---|---|---|---|
| present invention | | | | | | | | | |
| No. A | 15 | 15 | 18 | 1.00 | 0.60 | 15 | 0.5 | 9 | 0.10 |
| No. B | 6 | 9 | 14 | 1.50 | 0.90 | 15 | 1.0 | 4 | 0.10 |
| No. C | 3 | 2 | 1 | 0.67 | 0.20 | 6 | 1.2 | 0.6 | 0.05 |
| No. D | 30 | 15 | 45 | 0.50 | 1.00 | 9 | 0.2 | 18 | 0.13 |
| No. E | 20 | 6 | 10 | 0.30 | 0.38 | 13 | 0.5 | 15 | 0.17 |
| No. F | 40 | 40 | 90 | 1.00 | 1.06 | 8 | 0.1 | 16 | 0.08 |
| comparison examples | | | | | | | | | |
| No. G | 20 | 15 | — | 0.75 | — | — | — | 9 | 0.10 |
| No. H | 10 | 15 | 20 | 1.50 | 0.80 | — | — | — | |
| No. I | 30 | 5 | 2 | 0.17 | 0.06 | 45 | 1.29 | 4 | 0.03 |
| No. J | 15 | 15 | 7 | 1.00 | 0.18 | 20 | 1.0 | — | |
| No. K | 15 | 10 | 40 | 0.67 | 0.04 | — | — | — | |

TABLE 2

| | type of Zn-basis-plated steel sheet | chromate coating bath | chromate add-on g/m$^2$ | performance: alkali resistance (%) | corrosion resistance: without alkali rinse | corrosion resistance: after alkali rinse | corrosion resistance of painted sheet: without alkali rinse | corrosion resistance of painted sheet: after alkali rinse | paint adherence: checker-board test | paint adherence: Erichsen extrusion | paint adherence: welding tolerance |
|---|---|---|---|---|---|---|---|---|---|---|---|
| present | | | | | | | | | | | |

TABLE 2-continued

| | type of Zn-basis-plated steel sheet | chromate coating bath | chromate add-on g/m² | performance: alkali resistance (%) | corrosion resistance: without alkali rinse | corrosion resistance: after alkali rinse | corrosion resistance of painted sheet: without alkali rinse | corrosion resistance of painted sheet: after alkali rinse | paint adherence: checker-board test | paint adherence: Erichsen extrusion | paint adherence: welding tolerance |
|---|---|---|---|---|---|---|---|---|---|---|---|
| invention | | | | | | | | | | | |
| No. 1 | EG | No. A | 60 | 2 | +++ | +++ | 1.0 | 1.0 | +++ | +++ | — |
| No. 2 | EG | No. B | 30 | 0 | ++ | ++ | 1.0 | 1.0 | +++ | +++ | — |
| No. 3 | EG | No. C | 13 | 0 | ++ | ++ | 1.5 | 1.5 | ++ | ++ | — |
| No. 4 | EG | No. D | 80 | 3 | +++ | +++ | 1.0 | 0.5 | +++ | +++ | — |
| No. 5 | EG | No. E | 50 | 4 | +++ | +++ | 1.0 | 1.5 | +++ | +++ | — |
| No. 6 | EG | No. F | 140 | 2 | +++ | +++ | 0.5 | 0.5 | +++ | ++ | — |
| No. 7 | Zn/Ni | No. A | 60 | 3 | +++ | +++ | 0.5 | 0.5 | +++ | ++ | at least 1,000 spots |
| No. 8 | Zn/Ni | No. B | 30 | 2 | ++ | ++ | 0.5 | 0.5 | +++ | +++ | at least 1,000 spots |
| No. 9 | Zn/Ni | No. C | 13 | 0 | ++ | ++ | 1.0 | 1.5 | ++ | ++ | at least 1,000 spots |
| No. 10 | Zn/Ni | No. D | 80 | 1 | +++ | +++ | 0.5 | 0.5 | +++ | ++ | at least 1,000 spots |
| No. 11 | Zn/Ni | No. E | 50 | 0 | ++ | ++ | 0.5 | 0.5 | +++ | +++ | at least 1,000 spots |
| No. 12 | Zn/Ni | No. F | 110 | 5 | +++ | +++ | 0.5 | 0.5 | ++ | ++ | at least 1,000 spots |
| comparison examples | | | | | | | | | | | |
| No. 1 | EG | No. C | 8 | 30 | x | x | 3.5 | 4.0 | + | + | — |
| No. 2 | EG | No. G | 70 | 40 | ++ | x | 2.0 | 2.5 | ++ | ++ | — |
| No. 3 | EG | No. H | 50 | 40 | + | x | 2.0 | 3.0 | + | x | — |
| No. 4 | Zn/Ni | No. I | 80 | 8 | +++ | +++ | 0.5 | 0.5 | + | x | unweldable |
| No. 5 | Zn/Ni | No. J | 60 | 30 | ++ | x | 1.5 | 3.5 | + | x | at least 1,000 spots |
| No. 6 | Zn/Ni | No. K | 50 | 10 | ++ | + | 2.0 | 3.0 | x | x | at least 1,000 spots |

| PROCESS STEP SCHEMATIC CHART |
|---|
| steel sheet treatment workpiece (*1) → alkali degreasing (*2) → water rinse → roll squeegee → air drying → chromate coating → roll squeegee → drying (*3) |

Notes for Schematic Chart (*1) Steel sheet treatment workpieces (oiled, size = 200 × 300 millimeters (hereinafter "mm"); sheet thickness = 0.8 mm): steel sheet electrogalvanized on both sides, with 20 g/m² of zinc add-on on each side; and steel sheet, both sides zinc/nickel-alloy electroplated with 20 g/m² add-on wiehgt on each side of an alloy that contained 11 weight % nickel with the balance zinc.

(*2) Alkali degreasing was carried out by spraying with 2% weakly alkaline degreaser (Parclean TM 342 from Nihon Parkerizing Company, Limited) at 60° C. for 30 seconds.

(*3) Drying: sheet temperature = 100° C., drying time = 7 seconds.

(4) Performance evaluation testing (a) Alkali resistance testing

The chromate-treated steel was alkali rinsed as detailed below. The chromium add-on (mg/m²) was measured by x-ray fluorescence both before and after the alkali rinse, and the alkali resistance was calculated using the formula alkali resistance$=(W_b-W_a)/W_b$, where $W_b$ represents the chromium add-on weight before the alkaline rinse and $W_a$ represents the chromium add-on weight after the alkaline rinse. Thus, the alkali resistance increases as the calculated percentage declines, and a value of zero indicates absolutely no effect by alkali on the sample.

The alkali rinse consisted of a two-minute spray at 60° C. with a 2% aqueous solution of a sodium silicate-based alkaline degreaser (Parclean TM N364S from Nihon Parkerizing Company, Limited).

(b) Corrosion resistance before painting

1. Electrogalvanized steel sheet The test specimen (70×150 mm), either unrinsed or after the alkali rinse, was subjected to salt-spray testing for 150 hours as specified in JIS Z-2371. The corrosion resistance was reported with the symbols noted below, based on the development of white rust using the entire surface of the test specimen for evaluation.

| | |
|---|---|
| +++ | area of white rust development = 0% |
| ++ | 0% < area of white rust development < 10% |
| + | 10% ≦ area of white rust development < 30% |
| x | 30% ≦ area of white rust development |

2. Zi/Ni-alloy electroplated steel sheet The test specimen, either unrinsed or after the alkali rinse, was subjected to a 50-cycle composite corrosion resistance test. Each cycle consisted of salt spray for 4 hours, drying at 60° C. for 2 hours, and wetting for 2 hours at 50° C. and at least 95% Relative Humidity. The corrosion resistance was evaluated based on the development of red rust, using the entire surface of the test specimen for evaluation and was reported using the following symbols:

| | |
|---|---|
| +++ | area of red rust development = 0% |
| ++ | 0% < area of red rust development < 10% |
| + | 10% ≦ area of red rust development < 30% |
| x | 30% ≦ area of red rust development |

(c) Corrosion resistance of the painted sheet

The paint film was scribed with a cutter to reach the base metal, and salt-spray testing was then conducted for 200 hours in the case of the electrogalvanized steel sheet and for 300 hours in the case of the Zn/Ni-alloy electroplated steel sheet. This was followed by peeling with pressure-sensitive cellophane tape, and the maximum width in mm of the peel from one side of the cut was measured and reported as such.

(d) Paint film adherence

1. Checkerboard adhesion test A checkerboard of 1 mm squares was scribed on a painted test specimen (no alkali rinse) with a cutter to reach the base metal. Pressure-sensitive tape was pressed onto the surface of the test specimen and then rapidly peeled off. The amount of peeling by the paint film was subsequently inspected.
2. Erichsen extrusion test A painted test specimen (no alkali rinse) was punched out by 6 mm using an Erichsen extruder. Cellophane tape was pressed on and rapidly peeled off, and the amount of peeling by the paint film was evaluated.

The paint film adherence in these two tests was evaluated from the amount of paint film peeling based on the following 4 level scale:

| | |
|---|---|
| +++ | fraction of paint peeling = 0% |
| ++ | 0% < fraction of paint peeling < 10% |
| + | 10% ≦ fraction of paint peeling < 30% |
| x | 30% ≦ fraction of paint peeling |

(e) Welding tolerance

When Zn/Ni-alloy electroplated steel sheet is repeatedly spot welded under the conditions specified below, the weld tip gradually deteriorates and the weldability worsens. The weldability can therefore be evaluated from the rate of this deterioration. Thus, separate test specimens (30×100 mm) were welded with 100 weld spots each, and the number of weld spots was recorded for as long as the resulting test specimen could maintain a tensile strength of 400 kg. The welding conditions were:

| | |
|---|---|
| weld surface | treated surface to untreated surface |
| pressure | 200 kilograms force |
| current | 8.5 kiloamperes |
| weld time | 10 cycles |
| electrode | R40 (radius type) of chromium-copper |

BENEFITS OF THE INVENTION

As discussed hereinbefore, the present invention provides the surface of zinc coated steel with a chromate film which has an excellent alkali resistance, corrosion resistance, coatability, and welding tolerance. In contrast, Comparison Example 4 (chromate coating bath I) evidenced an inferior paint film adherence, believed to be due to its low chromium ion weight ratio and low phosphoric acid/total chromium ion weight ratio. Comparison Example 5 (chromate coating bath J) and Comparison Example 6 (chromate coating bath K) were inferior in all their properties (excepting the corrosion resistance without alkali rinse and the corrosion resistance of the painted sheet without alkali rinse); this is believed to be due to their lack of silane coupling agent.

The invention claimed is:

1. A method for the chromate treatment of zinc coated steel, said method comprising steps of:

(1) providing an aqueous liquid chromate containing composition as made by substeps (1.1)–(1.2) or by substeps (1.1')–(1.3'), where substeps (1.1)–(1.2) are:

(1.1) preparing a preliminary aqueous liquid composition which consists essentially of water and:

(1.1.1) a source of ions containing hexavalent chromium to provide from 3.5 to 50.0 grams per liter (hereinafter "g/L") of dissolved hexavalent chromium;

(1.1.2) a source of trivalent chromium ions to provide from 2.0 to 40.0 g/L of trivalent chromium: and (1.1.3) a source of phosphate ions to provide from 1.0 to 100 g/L of phosphate ions; and, optionally, (1.1.4) the residue from a reducing agent added to reduce some of the hexavalent chromium originally present to trivalent chromium, said preliminary aqueous liquid composition having a weight ratio of trivalent chromium to hexavalent chromium in the range from 0.25 to 1.5 and a weight ratio of phosphate ions to total chromium ion in the range from 0.1 to 1.2,; and (1.2) adding to the preliminary aqueous liquid composition prepared in step (1.1):

(1.2.1) an amount of colloidally dispersed silica that provides a ratio of from 0.1 to 1.2 for the weight of dispersed silica to total weight of chromium ions in the resulting composition; and (1.2.2) an amount of silane coupling agent that provides a ratio of the moles of silane coupling agent in the resulting composition to the moles of hexavalent chromium in the resulting composition in the range from 0.05 to 0.3;

and substeps (1.1') - (1.3') are:

(1.1') preparing a first aqueous partial composition comprising a source of hexavalent chromium and a source of trivalent chromium and, optionally, also comprising the residue from a reducing agent added to reduce some of the hexavalent chromium originally present to trivalent chromium;

(1.2') preparing a second aqueous partial composition comprising phosphate ions, dispersed colloidal silica, and a silane coupling agent; and (1.3') mixing said first and second aqueous partial compositions to produce an aqueous liquid chromate containing composition that could have been prepared by steps (1.1)–(1.2);

(2) covering the surface of the zinc coated steel with a layer of the aqueous liquid chromate containing composition provided in step (1), said layer containing from 10 to 150 milligrams of total chromium per square meter of zinc coated steel surface covered;

and (3) drying into place on the coated steel surface the covering liquid put in place in step (2).

2. A method according to claim 1, wherein steps (1.1)–(1.2) are used for the composition provided in step (1).

3. A method according to claim 2, wherein the silane coupling agent is selected from molecules conforming to one of the general formulas $(YR)_mSiX_n$ and $Y_mSiX_n$, wherein each of m and n, which may be the same or different, is a positive integer and:

$m+n=4$;

$n=1$, 2, or 3;

R=a moiety derived from an alkyl group by removing one hydrogen atom therefrom;

X=methoxy or ethoxy; and

Y=vinyl, mercapto, glycidoxy, or methacryloxy.

4. A method according to claim 1, wherein the silane coupling agent is selected from molecules conforming to one of the general formulas $(YR)_mSiX_n$ and $Y_mSiX_n$, wherein each of m and n, which may be the same or different, is a positive integer and:

m+n=4;

n=1, 2, or 3;

R=a moiety derived from an alkyl group by removing one hydrogen atom therefrom;

X=methoxy or ethoxy; and

Y=vinyl, mercapto, glycidoxy, or methacryloxy.

5. A method according to claim 4, wherein the molar ratio of silane coupling agent to hexavalent chromium at the time of applying the composition to the zinc coated steel is in the range from 0.1 to 0.2.

6. A method according to claim 3, wherein the molar ratio of silane coupling agent to hexavalent chromium at the time of applying the composition to the zinc coated steel is in the range from 0.1 to 0.2.

7. A method according to claim 2, wherein the molar ratio of silane coupling agent to hexavalent chromium at the time of applying the composition to the zinc coated steel is in the range from 0.1 to 0.2.

8. A method according to claim 1, wherein the molar ratio of silane coupling agent to hexavalent chromium at the time of applying the composition to the zinc coated steel is in the range from 0.1 to 0.2.

9. A method according to claim 8, wherein the pH of composition applied to the zinc coated steel is in the range from 1.0 to 3.0.

10. A method according to claim 7, wherein the pH of composition applied to the zinc coated steel is in the range from 1.0 to 3.0.

11. A method according to claim 6, wherein the pH of composition applied to the zinc coated steel is in the range from 1.0 to 3.0.

12. A method according to claim 5, wherein the pH of composition applied to the zinc coated steel is in the range from 1.0 to 3.0.

13. A method according to claim 4, wherein the pH of composition applied to the zinc coated steel is in the range from 1.0 to 3.0.

14. A method according to claim 3, wherein the pH of composition applied to the zinc coated steel is in the range from 1.0 to 3.0.

15. A method according to claim 2, wherein the pH of composition applied to the zinc coated steel is in the range from 1.0 to 3.0.

16. A method according to claim 1, wherein the pH of composition applied to the zinc coated steel is in the range from 1.0 to 3.0.

17. A method according to claim 12, wherein the drying is accomplished by heating the treated steel to a temperature in the range from 60°–150° C. for a time of from 5 to 10 seconds.

18. A method according to claim 11, wherein the drying is accomplished by heating the treated steel to a temperature in the range from 60°–150° C. for a time of from 5 to 10 seconds.

19. A method according to claim 10, wherein the drying is accomplished by heating the treated steel to a temperature in the range from 60°–150° C. for a time of from 5 to 10 seconds.

20. A method according to claim 9, wherein the drying is accomplished by heating the treated steel to a temperature in the range from 60°–150° C. for a time of from 5 to 10 seconds.

* * * * *